US007211374B2

(12) United States Patent
Irving et al.

(10) Patent No.: US 7,211,374 B2
(45) Date of Patent: May 1, 2007

(54) THERMALLY DEVELOPABLE MATERIAL PACKAGE WITH DUAL INDICATOR DEVICE

(75) Inventors: Mark E. Irving, Rochester, NY (US); David H. Levy, Rochester, NY (US); James H. Reynolds, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/067,240

(22) Filed: Feb. 25, 2005

(65) Prior Publication Data

US 2006/0194157 A1 Aug. 31, 2006

(51) Int. Cl.
*G03C 1/00* (2006.01)
*G03C 3/00* (2006.01)

(52) U.S. Cl. ..... 430/619; 430/617; 430/618; 430/620; 430/495.1

(58) Field of Classification Search ..... 430/617–620, 430/495.1
See application file for complete search history.

(56) References Cited

U.S. PATENT DOCUMENTS 3,999,946 A 12/1976 Patel et al.
5,120,137 A 6/1992 Ou-Yang
5,667,303 A 9/1997 Arens et al.
5,940,637 A 8/1999 Manico et al.
6,043,021 A 3/2000 Manico et al.
6,103,351 A 8/2000 Ram et al.
6,113,857 A 9/2000 Manico et al.
6,244,208 B1 6/2001 Qiu et al.
6,435,128 B2 8/2002 Qiu et al.
6,757,492 B1 6/2004 Hall

FOREIGN PATENT DOCUMENTS

WO WO96/28714 9/1996

*Primary Examiner*—Geraldina Visconti
(74) *Attorney, Agent, or Firm*—J. Lanny Tucker

(57) ABSTRACT

A package of thermographic or photothermographic materials has a primary packaging enclosure, and optionally a secondary packaging enclosure, containing one or more of the materials (such as individual sheets). A non-photosensitive indicator device is associated with either or both of the packaging enclosures. This non-photosensitive indicator device is adapted to provide a visually observable indication of a predetermined cumulative thermal exposure and a predetermined temperature event (that is, single temperature event) of the package. This indicator device is able to provide information as to the time-temperature history of the package.

21 Claims, No Drawings

THERMALLY DEVELOPABLE MATERIAL PACKAGE WITH DUAL INDICATOR DEVICE

FIELD OF THE INVENTION

The present invention relates to a package of thermally developable materials in which the packaging has a dual indicator device associated therewith. In particular, the dual indicator device provides a visually observable indication of a predetermined thermal exposure temperature and a predetermined cumulative thermal exposure of the packaged thermographic and photothermographic materials that aids in determining whether any degradation of the materials may have occurred from exposure to heat.

BACKGROUND OF THE INVENTION

Silver-containing thermographic and photothermographic imaging materials (that is, thermally developable imaging materials) that are imaged and/or developed using heat and without liquid processing have been known in the art for many years.

Silver-containing thermographic imaging materials are non-photo-sensitive materials that are used in a recording process wherein images are generated by the use of thermal energy. These materials generally comprise a support having disposed thereon (a) a relatively or completely non-photosensitive source of reducible silver ions, (b) a reducing composition (usually including a developer) for the reducible silver ions, and (c) a suitable hydrophilic or hydrophobic binder.

In a typical thermographic construction, the image-forming layers are based on silver salts of long chain fatty acids. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. At elevated temperatures, the silver of the silver carboxylate is reduced by a reducing agent for silver ion such as methyl gallate, hydroquinone, substituted-hydroquinones, hindered phenols, catechols, pyrogallol, ascorbic acid, and ascorbic acid derivatives, whereby an image of elemental silver is formed. Some thermographic constructions are imaged by contacting them with the thermal head of a thermographic recording apparatus such as a thermal printer or thermal facsimile. In such constructions, an anti-stick layer is coated on top of the imaging layer to prevent sticking of the thermographic construction to the thermal head of the apparatus utilized. The resulting thermographic construction is then heated to an elevated temperature, typically in the range of from about 60 to about 225° C., resulting in the formation of an image.

Silver-containing photothermographic imaging materials (that is, photosensitive thermally developable imaging materials) that are imaged with actinic radiation and then developed using heat and without liquid processing have been known in the art for many years. Such materials are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. This reaction occurs preferentially in the regions surrounding the latent image. This reaction produces a negative image of metallic silver having a color that ranges from yellow to deep black depending upon the presence of toning agents and other components in the photothermographic imaging layer(s).

Problem to be Solved

It is frequently desirable to be able to provide an indication whether a product has been exposed to an undesirable time-temperature history that results in substantial degradation of the product or to correct the time-temperature history during processing or use of the product. It may also be desirable to provide an indication whether a product has been exposed to an undesirable temperature, no matter what the length of exposure that results in substantial degradation of the product or complete product failure.

The rate of degradation at a given temperature is typically product dependent, that is, some types of products show a greater increase in the rate of change for a given temperature increase relative to other products. Moreover, certain types of products experience a greater rate of degradation after being exposed to, for no matter how briefly, an elevated temperature. Accordingly, it would be desirable to be able to have a visual indication of both cumulative thermal exposure and a peak thermal event exposure in which the rate of providing the visual indication of cumulative thermal exposure and thermal event exposure can be approximately matched to the rate of change, such as degradation, of the specific product to be monitored.

Thermally developable materials including photothermographic and thermographic materials are commercially available from several manufacturers and are usually packaged in sheet form with multiple sheets (perhaps 50 or more) in a light-tight plastic wrap or metal or plastic container or cartridge that is usually in a light-tight cardboard box. The sheets are then fed into an imaging and/or processing apparatus from the package or container as needed.

Packaged thermally developable materials are stored, transported, or used under a variety of environment conditions and thus they are exposed to various humidity and temperature conditions. Despite the fact that the individual sheets are usually in the light-tight packaging wrap exposure to environmental conditions such as heat over time, may adversely impact the performance of the materials and degrade their usefulness or shelf life.

It would be desirable to be able to provide an indication whether a particular thermally developable material has been exposed to an undesirable time-temperature history that results in substantial degradation of the product or to provide a time-temperature history that may be required during processing or use of the product. It may also be desirable to determine whether a thermally developable material has been exposed to a single temperature event.

A number of systems have been described for providing indicators useful in detecting whether a product has been exposed either to specific time-temperature combinations or simply to a particular temperature. For example, U.S. Pat. No. 3,999,946 (Patel et al.) describes the use of compositions containing at least two conjugated acetylene groups that exhibit sequences of irreversible color changes at combinations of times and temperatures.

Indicators for temperature-time exposure of various packaged photographic imaging products have been developed for several years as described in U.S. Pat. No. 6,113,857 (Patel et al.) and WO 96-28714 (Arens et al.). Indicators for providing information about the cumulative impact of thermal exposure also have been developed for canisters of wet-processed color photographic film as described in U.S. Pat. No. 5,940,637 (Manico et al.), U.S. Pat. No. 6,043,021 (Manico et al.), U.S. Pat. No. 6,103,351 (Ram et al.), and U.S. Pat. No. 6,113,857 (Manico et al.).

Because of the unique nature of the imaging chemistry and/or thermal developing conditions in thermally developable materials compared to conventional wet-processed photographic films, there is a need to provide a means for detecting the temperature-time history and single temperature events for packaged sheets of thermally developable materials.

SUMMARY OF THE INVENTION

This invention provides a packaged thermally developable product comprising:

a) a primary packaging enclosure containing one or more thermally developable materials, b) at least one non-photosensitive indicator device adapted to provide both a visually observable indication of a predetermined cumulative thermal exposure and a predetermined temperature event, c) optionally, a secondary packaging enclosure containing the primary packaging enclosure, wherein the indicator device is associated with either the primary or secondary packaging enclosure, or both.

While various individual indicator devices have been developed for various wet-processed packaged photographic products, the present invention provides two types of information on packaged thermally developable materials. The indicator device provides data for both a predetermined temperature event as well as a predetermined cumulative thermal exposure. This combination of data has not been previously provided in a single indicator device for packaged thermally developable materials such as photothermographic and thermographic materials.

DETAILED DESCRIPTION OF THE INVENTION

The packaged thermally developable materials described herein can be either thermographic and photothermographic materials. While the following discussion will often be directed primarily to the preferred photothermographic materials, it would be readily understood by one skilled in the art that thermographic materials can be similarly constructed and packaged. These materials can be used to provide black-and-white or color images using appropriate imaging chemistry and particularly non-photosensitive organic silver salts, reducing agents, toners, binders, and other components known to a skilled artisan.

The thermally developable materials can be used in black-and-white or color thermography and photothermography and in electronically generated black-and-white or color hardcopy recording. They can be used in microfilm applications, in radiographic imaging (for example digital medical imaging), X-ray radiography, and in industrial radiography.

The thermally developable materials are particularly useful for imaging of human or animal subjects in response to visible, X-radiation, or infrared radiation for use in a medical diagnosis. Such applications include, but are not limited to, thoracic imaging, mammography, dental imaging, orthopedic imaging, general medical radiography, therapeutic radiography, veterinary radiography, and autoradiography. When used with X-radiation, the photothermographic materials may be used in combination with one or more phosphor intensifying screens, with phosphors incorporated within the photothermographic emulsion, or with combinations thereof. Alternatively, such materials are useful for dental radiography when they are directly imaged by X-radiation. The materials are also useful for non-medical uses of X-radiation such as X-ray lithography and industrial radiography.

The photothermographic materials can be made sensitive to radiation of any suitable wavelength. Thus, in some embodiments, the materials are sensitive at ultraviolet, visible, infrared, or near infrared wavelengths, of the electromagnetic spectrum. In preferred embodiments, the materials are sensitive to radiation at 700 nm or greater (and generally up to about 950 nm). Increased sensitivity to a particular region of the spectrum is imparted through the use of various spectral sensitizing dyes.

In the photothermographic materials, the components needed for imaging can be in one or more photothermographic imaging layers on one side ("frontside") of the support. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity and preferably are in the same emulsion layer.

Similarly, in the thermographic materials, the components needed for imaging can be in one or more layers. The layer(s) that contain the non-photo-sensitive source of reducible silver ions are referred to herein as thermographic emulsion layer(s).

As the materials contain imaging layers on one side of the support only, various non-imaging layers are disposed on the "backside" (non-emulsion or non-imaging side) of the support, including at least one buried conductive layer and a "first" (overcoat) layer described herein, and optionally antihalation layer(s) and transport enabling layers.

Various non-imaging layers can also be disposed on the "frontside" or imaging or emulsion side of the support including protective topcoat layers, primer layers, interlayers, opacifying layers, antistatic layers, antihalation layers, acutance layers, auxiliary layers, and other layers readily apparent to one skilled in the art.

When the thermally developable materials are heat-developed as described below in a substantially water-free condition after, or simultaneously with, imagewise exposure, a silver image (preferably a black-and-white silver image) is obtained.

Definitions

As used herein:

In the descriptions of the thermally developable materials, "a" or "an" component refers to "at least one" of that component (for example, an indicator device) unless otherwise limited in scope.

"Photothermographic material(s)" means a construction comprising a support and at least one photothermographic emulsion layer or a photothermographic set of emulsion layers, wherein the photosensitive silver halide and the source of reducible silver ions are in one layer and the other necessary components or additives are distributed, as desired, in the same layer or in an adjacent coated layer. These materials also include multilayer constructions in which one or more imaging components are in different layers, but are in "reactive association." For example, one layer can include the non-photosensitive source of reducible silver ions and another layer can include the reducing composition, but the two reactive components are in reactive association with each other.

"Thermographic materials" are similarly defined except that no photosensitive silver halide catalyst is purposely added or created.

When used in photothermography, the term, "imagewise exposing" or "imagewise exposure" means that the material is imaged using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

When used in thermography, the term, "imagewise exposing" or "imagewise exposure" means that the material is imaged using any means that provides an image using heat. This includes, for example, by analog exposure where an image is formed by differential contact heating through a mask using a thermal blanket or infrared heat source, as well as by digital exposure where the image is formed one pixel at a time, such as by modulation of thermal print-heads or by thermal heating using scanning laser radiation.

"Catalytic proximity" or "reactive association" means that the reactive components are in the same layer or in adjacent layers so that they readily come into contact with each other during imaging and thermal development.

"Emulsion layer," "imaging layer," "thermographic emulsion layer," or "photothermographic emulsion layer" means a layer of a thermographic or photothermographic material that contains the photosensitive silver halide (when used) and/or non-photosensitive source of reducible silver ions, or a reducing composition. Such layers can also contain additional components or desirable additives. These layers are on what is known as the "frontside" of the support.

"Photocatalyst" means a photosensitive compound such as silver halide that, upon exposure to radiation, provides a compound that is capable of acting as a catalyst for the subsequent development of the image-forming material.

"Ultraviolet region of the spectrum" refers to that region of the spectrum less than or equal to 410 nm (preferably from about 100 nm to about 410 nm) although parts of these ranges may be visible to the naked human eye.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

"Transparent" means capable of transmitting visible light or imaging radiation without appreciable scattering or absorption.

As used herein, the phrase "silver organic coordinating ligand" refers to an organic molecule capable of forming a bond with a silver atom. Although the compounds so formed are technically silver coordination compounds they are also often referred to as silver salts.

*Research Disclosure* is a publication of Kenneth Mason Publications Ltd., Dudley House, 12 North Street, Emsworth, Hampshire PO10 7DQ England. It is also available from Emsworth Design Inc., 147 West 24th Street, New York, N.Y 10011.

Other aspects, advantages, and benefits of the present invention are apparent from the detailed description, examples, and claims provided in this application.

The Photocatalyst

Photothermographic materials include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver iodide are preferred. More preferred is silver bromoiodide in which any suitable amount of iodide is present up to almost 100 mol % iodide. Even more preferably, the silver bromoiodide comprises at least 70 mole % (preferably at least 85 mole % and most preferably at least 90 mole %) bromide (based on total silver halide). The remainder of the halide is either iodide or chloride, or both. Preferably, the additional halide is iodide.

In some embodiments of aqueous-based photothermographic materials, higher amounts of iodide may be present in homogeneous photo-sensitive silver halide grains, and particularly from about 20 mol % up to the saturation limit of iodide as described, for example, U.S. Patent Application Publication 2004/0053173 (Maskasky et al.).

The silver halide grains may have any crystalline habit or morphology including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of grains with different morphologies can be employed. Silver halide grains having cubic and tabular morphology (or both) are preferred.

The silver halide grains may have a uniform ratio of halide throughout. They may also have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

In some instances, it may be helpful to prepare the photosensitive silver halide grains in the presence of a hydroxytetrazaindene (such as 4-hydroxy-6-methyl-1,3,3a,7-tetrazaindene) or an N-heterocyclic compound comprising at least one mercapto group (such as 1-phenyl-5-mercaptotetrazole) as described in U.S. Pat. No. 6,413,710 (Shor et al.) that is incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. With this technique, one has the possibility of more precisely controlling the grain size, grain size distribution, dopant levels, and composition of the silver halide; so that one can impart more specific properties to both the silver halide grains and the resulting photothermographic material.

In some constructions, it is preferable to form the non-photo-sensitive source of reducible silver ions in the presence of ex-situ-prepared silver halide. In this process, the source of reducible silver ions, such as a long chain fatty acid silver carboxylate (commonly referred to as a silver "soap" or homogenate), is formed in the presence of the preformed silver halide grains. Co-precipitation of the source of reducible silver ions in the presence of silver halide provides a more intimate mixture of the two materials [see U.S. Pat. No. 3,839,049 (Simons)] to provide a material often referred to as a "preformed soap."

In some constructions, it is preferred that preformed silver halide grains be added to and "physically mixed" with the non-photosensitive source of reducible silver ions.

Preformed silver halide emulsions can be prepared by aqueous or organic processes and can be unwashed or washed to remove soluble salts. Soluble salts can be removed by any desired procedure for example as described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.).

It is also effective to use an in-situ process in which a halide- or a halogen-containing compound is added to an organic silver salt to partially convert the silver of the organic silver salt to silver halide. Inorganic halides (such as zinc bromide, zinc iodide, calcium bromide, lithium bromide, lithium iodide, or mixtures thereof) or an organic halogen-containing compound (such as N-bromo-succinimide or pyridinium hydrobromide perbromide) can be used. The details of such in-situ generation of silver halide are well known and described in U.S. Pat. No. 3,457,075 (Morgan et al.).

It is particularly effective to use a mixture of both preformed and in-situ generated silver halide. The preformed silver halide is preferably present in a preformed soap.

Additional methods of preparing silver halides and organic silver salts and blending them are described in *Research Disclosure*, June 1978, item 17029, U.S. Pat. No. 3,700,458 (Lindholm) and U.S. Pat. No. 4,076,539 (Ikenoue et al.), and Japanese Kokai 49-013224 (Fuji), 50-017216 (Fuji), and 51-042529 (Fuji).

The silver halide grains used in the imaging formulations can vary in average diameter of up to several micrometers (μm) depending on the desired use. Preferred silver halide grains for use in preformed emulsions containing silver carboxylates are cubic grains having an average particle size of from about 0.01 to about 1.5 μm, more preferred are those having an average particle size of from about 0.03 to about 1.0 μm, and most preferred are those having an average particle size of from about 0.03 to about 0.3 μm. Preferred silver halide grains for high-speed photothermographic use are tabular grains having an average thickness of at least 0.02 μm and up to and including 0.10 μm, an equivalent circular diameter of at least 0.5 μm and up to and including 8 μm and an aspect ratio of at least 5:1. More preferred are those having an average thickness of at least 0.03 μm and up to and including 0.08 μm, an equivalent circular diameter of at least 0.75 μm and up to and including 6 μm and an aspect ratio of at least 10:1.

The average size of the photosensitive silver halide grains is expressed by the average diameter if the grains are spherical, and by the average of the diameters of equivalent circles for the projected images if the grains are cubic or in other non-spherical shapes. Representative grain sizing methods are described in *Particle Size Analysis*, ASTM Symposium on Light Microscopy, R. P. Loveland, 1955, pp. 94–122, and in C. E. K. Mees and T. H. James, *The Theory of the Photographic Process*, Third Edition, Macmillan, N.Y., 1966, Chapter 2. Particle size measurements may be expressed in terms of the projected areas of grains or approximations of their diameters. These will provide reasonably accurate results if the grains of interest are substantially uniform in shape.

The one or more light sensitive silver halides are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical Sensitization

The photosensitive silver halides can be chemically sensitized using any useful compound that contains sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), and U.S. Pat. No. 5,759,761 (Lushington et al.), and EP 0 915 371A1 (Lok et al.), all of which are incorporated herein by reference.

Mercaptotetrazoles and tetraazindenes as described in U.S. Pat. No. 5,691,127 (Daubendiek et al.), incorporated herein by reference, can also be used as suitable addenda for tabular silver halide grains.

Certain substituted and unsubstituted thiourea compounds can be used as chemical sensitizers including those described in U.S. Pat. No. 6,368,779 (Lynch et al.) that is incorporated herein by reference.

Still other additional chemical sensitizers include certain tellurium-containing compounds that are described in U.S. Pat. No. 6,699,647 (Lynch et al.), and certain selenium-containing compounds that are described in U.S. Pat. No. 6,620,577 (Lynch et al.), that are both incorporated herein by reference.

Combinations of gold(III)-containing compounds and either sulfur-, tellurium-, or selenium-containing compounds are also useful as chemical sensitizers as described in U.S. Pat. No. 6,423,481 (Simpson et al.) that is also incorporated herein by reference.

In addition, sulfur-containing compounds can be decomposed on silver halide grains in an oxidizing environment according to the teaching in U.S. Pat. No. 5,891,615 (Winslow et al.). Examples of sulfur-containing compounds that can be used in this fashion include sulfur-containing spectral sensitizing dyes.

Other useful sulfur-containing chemical sensitizing compounds that can be decomposed in an oxidized environment are the diphenylphosphine sulfide compounds described in U.S. Pat. No. 7,026,105 (Simpson et al.) which application is incorporated herein by reference.

The chemical sensitizers can be present in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 2 μm.

Spectral Sensitization

The photosensitive silver halides may be spectrally sensitized with one or more spectral sensitizing dyes that are known to enhance silver halide sensitivity to ultraviolet, visible, and/or infrared radiation (that is, sensitivity within the range of from about 300 to about 1400 nm). Non-limiting examples of spectral sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. They may be added at any stage in chemical finishing of the photothermographic emulsion, but are generally added after chemical sensitization is achieved.

Suitable spectral sensitizing dyes such as those described in U.S. Pat. No. 3,719,495 (Lea), U.S. Pat. No. 4,396,712 (Kinoshita et al.), U.S. Pat. No. 4,439,520 (Kofron et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al.), U.S. Pat. No. 5,441,866 (Miller et al.), U.S. Pat. No. 5,508,162 (Dankosh), U.S. Pat. No. 5,510,236 (Dankosh), and U.S. Pat. No. 5,541,054 (Miller et al.), Japanese Kokai 2000-063690 (Tanaka et al.), 2000-112054 (Fukusaka et al.), 2000-273329 (Tanaka et al.), 2001-005145 (Arai), 2001-064527 (Oshiyama et al.), and 2001-154305 (Kita et al.), can be used in the practice of the invention. All of the publications noted above are incorporated herein by reference. Useful spectral sensitizing dyes are also described in *Research Disclosure*, December 1989, item 308119, Section IV and *Research Disclosure,* 1994, item 36544, section V.

Teachings relating to specific combinations of spectral sensitizing dyes also include U.S. Pat. No. 4,581,329 (Sugimoto et al.), U.S. Pat. No. 4,582,786 (Ikeda et al.), U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.). All of the above publications and patents are incorporated herein by reference.

Also useful are spectral sensitizing dyes that decolorize by the action of light or heat as described in U.S. Pat. No. 4,524,128 (Edwards et al.) and Japanese Kokai 2001-109101 (Adachi), 2001-154305 (Kita et al.), and 2001-183770 (Hanyu et al.), all incorporated herein by reference.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions in the thermally developable materials is a silver-organic compound that contains reducible silver(I) ions. Such compounds are generally silver salts of silver organic coordinating ligands that are comparatively stable to light and form a silver image when heated to 50° C. or higher in the presence of an exposed photocatalyst (such as silver halide, when used in a photothermographic material) and a reducing agent composition.

The primary organic silver salt is often a silver salt of an aliphatic carboxylate (described below). Mixtures of silver salts of aliphatic carboxylates are particularly useful where the mixture includes at least silver behenate.

Useful silver carboxylates include silver salts of long-chain aliphatic carboxylic acids. The aliphatic carboxylic acids generally have aliphatic chains that contain 10 to 30, and preferably 15 to 28, carbon atoms. Examples of such preferred silver salts include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Most preferably, at least silver behenate is used alone or in mixtures with other silver carboxylates.

Silver salts other than the silver carboxylates described above can be used also. Such silver salts include silver salts of aliphatic carboxylic acids containing a thioether group as described in U.S. Pat. No. 3,330,663 (Weyde et al.), soluble silver carboxylates comprising hydrocarbon chains incorporating ether or thioether linkages or sterically hindered substitution in the α- (on a hydrocarbon group) or ortho- (on an aromatic group) position as described in U.S. Pat. No. 5,491,059 (Whitcomb), silver salts of dicarboxylic acids, silver salts of sulfonates as described in U.S. Pat. No. 4,504,57[5] (Lee), silver salts of sulfosuccinates as described in EP 0 227 141A1 (Leenders et al.), silver salts of aromatic carboxylic acids (such as silver benzoate), silver salts of acetylenes as described, for example in U.S. Pat. No. 4,761,361 (Ozaki et al.) and U.S. Pat. No. 4,775,613 (Hirai et al.), and silver salts of heterocyclic compounds containing mercapto or thione groups and derivatives as described in U.S. Pat. No. 4,123,274 (Knight et al.) and U.S. Pat. No. 3,785,830 (Sullivan et al.).

It is also convenient to use silver half soaps such as an equimolar blend of silver carboxylate and carboxylic acid that analyzes for about 14.5% by weight solids of silver in the blend and that is prepared by precipitation from an aqueous solution of an ammonium or an alkali metal salt of a commercially available fatty carboxylic acid, or by addition of the free fatty acid to the silver soap.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

Sources of non-photosensitive reducible silver ions can also be core-shell silver salts as described in U.S. Pat. No. 6,355,408 (Whitcomb et al.) that is incorporated herein by reference. Other useful sources of non-photosensitive reducible silver ions are the silver dimer compounds as described in U.S. Pat. No. 6,472,131 (Whitcomb) that is incorporated herein by reference.

Still other useful sources of non-photosensitive reducible silver ions are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in U.S. Pat. No. 6,802,177 (Bokhonov et al.) that is incorporated herein by reference.

Organic silver salts that are particularly useful in organic solvent-based thermographic and photothermographic materials include silver carboxylates (both aliphatic and aromatic carboxylates), silver triazolates, silver sulfonates, silver sulfosuccinates, and silver acetylides.

Organic silver salts that are particularly useful in aqueous based thermographic and photothermographic materials include silver salts of compounds containing an imino group. Preferred examples of these compounds include, but are not limited to, silver salts of benzotriazole and substituted derivatives thereof (for example, silver methylbenzotriazole and silver 5-chloro-benzotriazole), silver salts of 1,2,4-triazoles or 1-H-tetrazoles such as phenyl-mercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole and substituted derivatives thereof especially in aqueous-based thermographic and photothermographic formulations.

Useful nitrogen-containing organic silver salts and methods of preparing them are described in U.S. Pat. No. 6,977,139 (Zou et al.) that is incorporated herein by reference. Such silver salts (particularly the silver benzotriazoles) are rod-like in shape and have an average aspect ratio of at least 3:1 and a width index for particle diameter of 1.25 or less. Silver salt particle length is generally less than 1 μm. Also useful are the silver salt-toner co-precipitated nanocrystals comprising a silver salt of a nitrogen-containing heterocyclic compound containing an imino group, and a silver salt comprising a silver salt of a mercaptotriazole as described in U.S. Pat. No. 7,008,748 (Hasberg et al.) Both of these patent applications are incorporated herein by reference.

The one or more non-photosensitive sources of reducible silver ions are preferably present in an amount of from about 5% to about 70%, and more preferably from about 10% to about 50%, based on the total dry weight of the emulsion layers. Alternatively stated, the amount of the sources of reducible silver ions is generally from about 0.001 to about 0.2 mol/m$^2$ of the dry photothermographic material (preferably from about 0.01 to about 0.05 mol/m$^2$).

The total amount of silver (from all silver sources) in the thermographic and photothermographic materials is generally at least 0.002 mol/m$^2$ and preferably from about 0.01 to about 0.05 mol/m$^2$.

Reducing Agents

The reducing agent (or reducing agent, composition comprising two or more components) for the source of reducible silver ions can be any material (preferably an organic material) that can reduce silver(I) ion to metallic silver. The "reducing agent" is sometimes called a "developer" or "developing agent."

When a silver benzotriazole silver source is used, ascorbic acid reducing agents are preferred. An "ascorbic acid" reducing agent (also referred to as a developer or developing agent) means ascorbic acid, complexes, and derivatives thereof. An "ascorbic acid" reducing agent means ascorbic acid, complexes, and derivatives thereof. Ascorbic acid reducing agents are described in a considerable number of publications including U.S. Pat. No. 5,236,816 (Purol et al.) and references cited therein. Useful ascorbic acid developing agents include ascorbic acid and the analogues, isomers and derivatives thereof. Such compounds include, but are not limited to, D- or L- ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid; glucoheptoascorbic acid, maltoascorbic acid, L-arabosascorbic acid), sodium ascorbate, potassium ascorbate, isoascorbic acid (or L-erythroascorbic acid), and:salts thereof (such as alkali metal, ammonium, or others known in the art), endiol type ascorbic acid, an enaminol type ascorbic acid, a thioenol type ascorbic acid, and an enamin-thiol type ascorbic acid, as described in EP 0 585 792A1 (Passarella et al.), EP 0 573 700A1 (Lingier et al.), EP 0 588 408A1 (Hieronymus et al.), U.S. Pat. No. 5,089,819 (Knapp), U.S. Pat. No. 2,688,549 (James et al.), U.S. Pat. No. 5,278,035 (Knapp), U.S. Pat. No. 5,384,232 (Bishop et al.), U.S. Pat. No. 5,376,510 (Parker et al.), and U.S. Pat. No. 5,49851 1 (Yamashita et al.), Japanese Kokai 7-56286 (Toyoda), and *Research Disclosure*, item 37152, March 1995. Mixtures of these developing agents can be used if desired. Ascorbic acid esters such as an ascorbic acid palmitate are particularly useful.

Also useful are the ascorbic acid reducing agents described in commonly assigned U.S. Publication 2005/0164136 (Ramsden et al.). Also useful are the solid particle dispersions of certain ascorbic acid esters that are prepared in the presence of a particle growth modifier that are described in commonly assigned U.S. Publication 2006/005 1714 (Brick et al.). Both of these patent applications are incorporated herein by reference.

When a silver carboxylate silver source is used in a photothermographic material, one or more hindered phenol reducing agents are preferred. In some instances, the reducing agent composition comprises two or more components such as a hindered phenol developer and a co-developer that can be chosen from the various classes of co-developers and reducing agents described below. Ternary developer mixtures involving the further addition of contrast enhancing agents are also useful. Such contrast enhancing agents can be chosen from the various classes of reducing agents described below.

"Hindered phenol reducing agents" are compounds that contain only one hydroxy group on a given phenyl ring and have at least one additional substituent located ortho to the hydroxy group. One type of hindered phenol includes hindered phenols and hindered naphthols.

Another type of hindered phenol reducing agent are hindered bis-phenols. These compounds contain more than one hydroxy group each of which is located on a different phenyl ring. This type of hindered phenol includes, for example, binaphthols (that is dihydroxybinaphthyls), biphenols (that is dihydroxybiphenyls), bis(hydroxynaphthyl) methanes bis(hydroxyphenyl)methanes, bis(hydroxyphenyl) ethers, bis(hydroxyphenyl)sulfones, and bis (hydroxyphenyl)thioethers, each of which may have additional substituents.

Preferred hindered phenol reducing agents are bis(hydroxyphenyl)methanes such as, bis(2-hydroxy3-t-butyl-5-methylphenyl)methane (CAO-5), 1,1'-bis(2-hydroxy-3,5-dimethylphenyl)-3,5,5-trimethylhexane (NONOX® or PERMANAX WSO), and 1,1'-bis(2-hydroxy-3,5-dimethylphenyl)-isobutane (LOWINOX® 22IB46) Mixtures of hindered phenol reducing agents can be used if desired.

An additional class of reducing agents that can be used includes substituted hydrazines including the sulfonyl hydrazides described in U.S. Pat. No. 5,464,738 (Lynch et al.). Still other useful reducing agents are described in U.S. Pat. No. 3,074,809 (Owen), U.S. Pat. No. 3,094,417 (Workman), U.S. Pat. No. 3,080,254 (Grant, Jr.), U.S. Pat. No. 3,887,417 (Klein et al.), and U.S. Pat. No. 5,981,151 (Leenders et al.). All of these patents are incorporated herein by reference.

Additional reducing agents that may be used include amidoximes, azines, a combination of aliphatic carboxylic acid aryl hydrazides and ascorbic acid, a reductone and/or a hydrazine, piperidinohexose reductone or formyl-4-methylphenylhydrazine, hydroxamic acids, a combination of azines and sulfonamidophenols, α-cyanophenylacetic acid derivatives, reductones, indane-1,3-diones, chromans, 1,4-dihydropyridines, and 3-pyrazolidones.

Useful co-developer reducing agents can also be used as described in U.S. Pat. No. 6,387,605 (Lynch et al.). Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). Yet another class of co-developers includes substituted acrylonitrile compounds as described in U.S. Pat. No. 5,635,339 (Murray) and CN-01 through CN-13 in U.S. Pat. No. 5,545,515 (Murray et al.). All of the patents above are incorporated herein by reference.

Various contrast enhancing agents can be used in some photothermographic materials with specific co-developers.

When used with a silver carboxylate silver source in a thermographic material, preferred reducing agents are aromatic di- and tri-hydroxy compounds having at least two hydroxy groups in ortho- or para-relationship on the same aromatic nucleus. Examples are hydroquinone and substituted hydroquinones, catechols, pyrogallol, gallic acid and gallic acid esters (for example, methyl gallate, ethyl gallate, propyl gallate), and tannic acid.

Particularly preferred are catechol-type reducing agents having no more than two hydroxy groups in an ortho-relationship.

One particularly preferred class of catechol-type reducing agents are benzene compounds in which the benzene nucleus is substituted by no more than two-hydroxy groups which are present in 2,3-position on the nucleus and have in the 1-position of the nucleus a substituent linked to the nucleus by means of a carbonyl group. Compounds of this type include 2,3-dihydroxy-benzoic acid, and 2,3-dihydroxy-benzoic acid esters (such as methyl 2,3-dihydroxy-benzoate, and ethyl 2,3-dihydroxy-benzoate).

Another particularly preferred class of catechol-type reducing agents are benzene compounds in which the benzene nucleus is substituted by no more than two hydroxy groups which are present in 3,4-position on the nucleus and have in the 1-position of the nucleus a substituent linked to the nucleus by means of a carbonyl group. Compounds of this type include, for example, 3,4-dihydroxy-benzoic acid, 3-(3,4-dihydroxy-phenyl)-propionic acid, 3,4-dihydroxy-benzoic acid esters (such as methyl 3,4-dihydroxy-benzoate, and ethyl 3,4-dihydroxy-benzoate), 3,4-dihydroxy-benzaldehyde, 3,4-dihydroxy-benzonitrile, and phenyl-(3,4-dihydroxyphenyl)ketone. Such compounds are described, for example, in U.S. Pat. No. 5,582,953 (Uyttendaele et al.).

Still another useful class of reducing agents includes polyhydroxy spiro-bis-indane compounds described as photographic tanning agents in U.S. Pat. No. 3,440,049 (Moede).

Aromatic di- and tri-hydroxy reducing agents can also be used in combination with hindered phenol reducing agents and further in combination with one or more high contrast co-developing agents and co-developer contrast-enhancing agents).

Where the thermally developable materials are used to provide color images, the reducing agent can be any useful material, such as a leuco dye, that will react to provide a dye or color image during thermal processing.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Co-developers may be present generally in an amount of from about 0.001% to about 1.5% (dry weight) of the emulsion layer coating.

Other Addenda

The thermally developable materials can also contain other additives such as shelf-life stabilizers, antifoggants, contrast enhancers, development accelerators, acutance dyes, post-processing stabilizers or stabilizer precursors, thermal solvents (also known as melt formers), and other image-modifying agents as would be readily apparent to one skilled in the art.

To further control the properties of photothermographic materials, (for example, contrast, $D_{min}$, speed, or fog), it may be preferable to add one or more heteroaromatic mercapto compounds or heteroaromatic disulfide compounds of the formulae Ar—S-$M^1$ and Ar—S—S—Ar, wherein $M^1$ represents a hydrogen atom or an alkali metal atom and Ar represents a heteroaromatic ring or fused hetero-aromatic ring containing one or more of nitrogen, sulfur, oxygen, selenium, or tellurium atoms. Useful heteroaromatic mercapto compounds are described as supersensitizers for infrared photothermographic materials in EP 0 559 228B1 (Philip Jr. et al.).

A heteroaromatic mercapto compound is generally present in an emulsion layer in an amount of at least 0.0001 mole (preferably from about 0.001 to about 1.0 mole) per mole of total silver in the emulsion layer.

Preferably, the photothermographic materials include one or more polyhalo compounds that function as antifoggants and/or stabilizers that contain one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds. Particularly useful antifoggants are polyhalo antifoggants, such as those having a $—SO_2C(X')_3$ group wherein X' represents the same or different halogen atoms. Preferred compounds are those having $—SO_2CBr_3$ groups as described in U.S. Pat. No. 3,874,946 (Costa et al.), U.S. Pat. No. 5,374,514 (Kirk et al.), U.S. Pat. No. 5,460,938 (Kirk et al.), and U.S. Pat. No. 5,594,143 (Kirk et al.). Non-limiting examples of such compounds include, 2-tribromomethylsulfonylquinoline, 2-tribromomethyl-sulfonylpyridine, tribromomethylbenzene, and substituted derivatives of these compounds. If present, these polyhalo antifoggants are present in an amount of at least 0.005 mol/mol of total silver, preferably in an amount of from about 0.02 to about 0.10 mol/mol of total silver, and more preferably in an amount of from 0.029 to 0.10 mol/mol of total silver.

Stabilizer precursor compounds capable of releasing stabilizers upon application of heat during development can also be used as described in U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) may be useful as described in U.S. Pat. No. 6,171,767 (Kong et al.).

Other useful antifoggants/stabilizers are described in U.S. Pat. No. 6,083,681 (Lynch et al.). Still other antifoggants are hydrobromic acid salts of heterocyclic compounds (such as pyridinium hydrobromide perbromide) as described in U.S. Pat. No. 5,028,523 (Skoug), benzoyl acid compounds as described in U.S. Pat. No. 4,784,939 (Pham), substituted propenenitrile compounds as described in U.S. Pat. No. 5,686,228 (Murray et al.), silyl blocked compounds as described in U.S. Pat. No. 5,358,843 (Sakizadeh et al.), vinyl sulfones as described in U.S. Pat. No. 6,143,487 (Philip, Jr. et al.), diisocyanate compounds as described in EP 0 600 586A1 (Philip, Jr. et al.), and tribromomethylketones as described in EP 0 600 587A1 (Oliff et al.).

The photothermographic materials may also include one or more thermal solvents (or melt formers) such as disclosed in U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender).

"Toners" or derivatives thereof that improve the image are highly desirable components of the thermally developable materials. Toners (also known as "toning agents") are compounds that when added to the imaging layer(s) shift the color of the developed silver image from yellowish-orange to brown-black or blue-black and/or increase the rate of development. Generally, one or more toners described herein are present in an amount of about 0.01% by weight to about 10%, and more preferably about 0.1% by weight to about 10% by weight, based on the total dry weight of the layer in which it is included. Toners may be incorporated in the photothermographic emulsion layer(s) or in an adjacent non-imaging layer.

Compounds useful as toners are described in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), and U.S. Pat. No. 5,599,647 (Defieuw et al.) and GB 1,439,478 (AGFA).

Phthalazine and phthalazine derivatives [such as those described in U.S. Pat. No. 6,146,822 (Asanuma et al.), incorporated herein by reference], phthalazinone, and phthalazinone derivatives are particularly useful toners.

Additional useful toners are substituted and unsubstituted mercaptotriazoles as described in U.S. Pat. No. 3,832,186 (Masuda et al.), U.S. Pat. No. 6,165,704 (Miyake et al.), U.S. Pat. No. 5,149,620 (Simpson et al.), and U.S. Pat. No. 6,713,240 (Lynch et al.), and U.S. Patent Application Publication 2004/0013984 (Lynch et al.), all of which are incorporated herein by reference.

Also useful are the phthalazine compounds described in U.S. Pat. No. 6,605,418 (Ramsden et al.), the triazine thione compounds described in U.S. Pat. No. 6,703,191 (Lynch et al.), and the heterocyclic disulfide compounds described in U.S. Pat. No. 6,737,227 (Lynch et al.), all of which are incorporated herein by reference.

Further useful are the silver salt-toner co-precipitated nano-crystals described in U.S. Pat. No. 7,008,748 (Hasberg et al.) and noted above.

The photothermographic materials can also include one or more image stabilizing compounds that are usually incorporated in a "backside" layer. Such compounds can include phthalazinone and its derivatives, pyridazine and its derivatives, benzoxazine and benzoxazine derivatives, benzothiazine dione and its derivatives, and quinazoline dione and its derivatives, particularly as described in U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al) and GB 1,565,043 (Fuji Photo). All of these patents and patent applications are incorporated herein by reference.

Phosphors are materials that emit infrared, visible, or ultraviolet radiation upon excitation and can be incorporated into the photothermographic materials. Particularly useful phosphors are sensitive to X-radiation and emit radiation primarily in the ultraviolet, near-ultraviolet, or visible regions of the spectrum (that is, from about 100 to about 700 nm). An intrinsic phosphor is a material that is naturally (that is, intrinsically) phosphorescent. An "activated" phosphor is one composed of a basic material that may or may not be an intrinsic phosphor, to which one or more dopant(s) has been intentionally added. These dopants or activators "activate" the phosphor and cause it to emit ultraviolet or visible radiation. Multiple dopants may be used and thus the phosphor would include both "activators" and "co-activators."

Any conventional or useful phosphor can be used, singly or in mixtures. For example, useful phosphors are described in numerous references relating to fluorescent intensifying screens as well as U.S. Pat. No. 6,440,649 (Simpson et al.) and U.S. Pat. No. 6,573,033 (Simpson et al.) that are directed to photothermographic materials, both of which references are incorporated herein.

Some particularly useful phosphors are primarily "activated" phosphors known as phosphate phosphors and borate phosphors. Examples of these phosphors are rare earth phosphates, yttrium phosphates, strontium phosphates, or strontium fluoroborates (including cerium activated rare earth or yttrium phosphates, or europium activated strontium fluoroborates) as described in U.S. Publication 2005/0233269 (Simpson et al.).

The one or more phosphors can be present in the photothermographic materials in an amount of at least 0.1 mole per mole, and preferably from about 0.5 to about 20 mole, per mole of total silver in the photothermographic material. As noted above, generally, the amount of total silver is at least 0.002 mol/$m^2$.

Binders

The photosensitive silver halide (if present), the non-photosensitive source of reducible silver ions, the reducing agent composition, and any other imaging layer additives are generally combined with one or more binders that are generally hydrophobic or hydrophilic in nature. Thus, either aqueous or organic solvent-based formulations can be used to prepare the thermally developable materials of this invention. Mixtures of either or both types of binders can also be used. It is preferred that the binder be selected from predominantly hydrophobic polymeric materials (at least 50 dry weight % of total binders).

Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available under the names BUTVAR® (Solutia, Inc., St. Louis, Mo.) and PIOLOFORM® (Wacker Chemical Company, Adrian, Mich.). The polyvinyl acetals, for example, can be of any suitable molecular weight, but as described below, the backside layers must contain at least one lower molecular weight (below 30,000) polyvinyl acetal as a binder.

Hydrophilic binders or water-dispersible polymeric latex polymers can also be present in the formulations. Examples of useful hydrophilic binders include, but are not limited to, proteins and protein derivatives, gelatin and gelatin-like derivatives (hardened or unhardened), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides and other synthetic or naturally occurring vehicles commonly known for use in aqueous-based photographic emulsions (see for example, *Research Disclosure*, item 38957, noted above). Cationic starches can also be used as a peptizer for tabular silver halide grains as described in U.S. Pat. No. 5,620,840 (Maskasky) and U.S. Pat. No. 5,667,955 (Maskasky).

Hardeners for various binders may be present if desired. Useful hardeners are well known and include diisocyanate compounds as described in EP 0 600 586 B1 (Philip, Jr. et al.), vinyl sulfone compounds as described in U.S. Pat. No. 6,143,487 (Philip, Jr. et al.) and EP, 0 640 589 A1 (Gathmann et al.), aldehydes and various other hardeners as described in U.S. Pat. No. 6,190,822 (Dickerson et al.). The hydrophilic binders used in the photothermographic materials are generally partially or fully hardened using any conventional hardener. Useful hardeners are well known and are described, for example, in T. H. James, *The Theory of the Photographic Process*, Fourth Edition, Eastman Kodak Company, Rochester, N.Y., 1977, Chapter 2, pp. 77–8.

Where the proportions and activities of the thermally developable materials require a particular developing time and temperature, the binder(s) should be able to withstand those conditions. When a hydrophobic binder is used, it is preferred that the binder (or mixture thereof) does not decompose or lose its structural integrity at 120° C. for 60 seconds. When a hydrophilic binder is used, it is preferred that the binder does not decompose or lose its structural integrity at 150° C. for 60 seconds. It is more preferred that it does not decompose or lose its structural integrity at 177° C. for 60 seconds.

The polymer binder(s) is used in an amount sufficient to carry the components dispersed therein. Preferably, a binder is used at a level of from about 10% to about 90% by weight (more preferably at a level of from about 20% to about 70% by weight) based on the total dry weight of the layer. It is particularly useful that the thermally developable materials include at least 50 weight % hydrophobic binders in both imaging and non-imaging layers on both sides of the support (and particularly the imaging-side of the support).

Support Materials

The thermally developable materials comprise a polymeric support that is preferably a flexible, transparent film that has any desired thickness and is composed of one or more polymeric materials. They are required to exhibit dimensional stability during thermal development and to have suitable adhesive properties with overlying layers. Useful polymeric materials for making such supports include polyesters [such as poly(ethylene terephthalate) and poly(ethylene naphthalate)], cellulose, acetate and other cellulose esters, polyvinyl acetal, polyolefins, polycarbonates, and polystyrenes. Preferred supports are composed of polymers having good heat stability, such as polyesters and polycarbonates. Support materials may also be treated or annealed to reduce shrinkage and promote dimensional stability.

Support materials can contain various colorants, pigments, antihalation or acutance dyes if desired. For example, the support can include one or more dyes that provide a blue color in the resulting imaged film. Support materials may be treated using conventional procedures (such as corona discharge) to improve adhesion of overlying layers, or subbing or other adhesion-promoting layers can be used.

Thermographic and Photothermographic Formulations and Constructions

An organic solvent-based coating formulation for the thermographic and photothermographic emulsion layer(s) can be prepared by mixing the various components with one or more binders in a suitable organic solvent system that usually includes one or more solvents such as toluene, 2-butanone (methyl ethyl ketone), acetone, or tetrahydrofuran, or mixtures thereof.

Alternatively, the desired imaging components can be formulated with a hydrophilic binder (such as gelatin, a gelatin-derivative, or a latex) in water or water-organic solvent mixtures, to provide aqueous-based coating formulations.

In some embodiments, the thermally developable materials include a surface protective layer over one or more imaging layers. In all embodiments, the materials include an overcoat layer on the backside that includes the required buried conductive antistatic composition (with or without an antihalation composition or layer).

Backside Compositions and Layers

The thermally developable materials can have at least one buried conductive layer on the backside (non-imaging side) of the polymeric support along with one or more additional overcoat layers. Such additional layers may further include an optional antihalation layer, a layer containing a matting agent (such as silica), or a combination of such layers. Alternatively, one of the additional backside layers can perform several or all of the desired additional functions.

Preferably, at least one buried conductive layer on the backside (non-imaging side) of the support includes a conductive material such as nanoparticles of $TiO_2$, $SnO_2$, $Al_2O_3$, $ZrO_2$, $In_2O_3$, ZnO, $TiB_2$, $ZrB_2$, $NbB_2$, $TaB_2$, $CrB_2$, MoB, WB, $LaB_6$, ZrN, TiN, TiC, WC, HfC, HfN, ZrC, acicular and non-acicular zinc antimonate ($ZnSb_2O_6$), indium-doped tin oxide, antimony-doped tin oxide, aluminum-doped zinc oxide, tungsten trioxide, vanadium pentoxide, molybdenum trioxide, and niobium-doped titanium oxide. Conductive metal oxide nanoparticles are more preferred and non-acicular metal antimonates are most preferred.

There can be at least two backside layers and at least one non-imaging backside layer is a non-imaging conductive layer that is a "buried" conductive layer and a protective overcoat layer is disposed over it. More preferably the conductive layer is a "buried" carrier layer containing non-acicular metal antimonate nanoparticles.

While the following disclosure is directed primarily to the use of metal antimonate particles in the "buried" backside conductive layer, it is understood that a skilled artisan would know how to adapt the teaching to the use of other conductive metal oxides known in the art.

The preferred non-acicular metal antimonate nanoparticles generally have a composition represented by the following Structure I or II:

$$M^{+2}Sb^{+5}{}_2O^6 \quad \text{(I)}$$

wherein M is zinc, nickel, magnesium, iron, copper, manganese, or cobalt, $$M_a{}^{+3}Sb^{+5}O_4 \quad \text{(II)}$$

wherein $M_a$ is indium, aluminum, scandium, chromium, iron, or gallium.

Thus, these nanoparticles are generally metal oxides that are doped with antimony.

Preferably, the non-acicular metal antimonate nanoparticles are composed of zinc antimonate ($ZnSb_2O_6$). Several conductive metal antimonates are commercially available from Nissan Chemical America Corporation. Alternatively, the metal antimonate particles can be prepared using methods described for example in U.S. Pat. No. 5,457,013 (noted above) and references cited therein.

The metal oxide particles (such as the preferred non-acicular metal antimonate nanoparticles) are generally present in an amount sufficient to provide a backside water electrode resistivity (WER) of $1\times10^{12}$ ohms/sq or less and preferably $1\times10^{11}$ ohms/sq or less at 70° F. (21.1° C.) and 50% relative humidity.

The metal oxide particles (such as the preferred non-acicular metal antimonate nanoparticles) generally comprise from about more than 40 and up to about 80% (preferably from about 65 to about 75%) by weight of the dry backside conductive layer. Thus, the weight % of the polymer mixture in the dry backside conductive layer is from about 20 to about 60 weight % and preferably from about 25 to about 35 weight %). Another way of defining the amount of particles is that they are generally present in the backside conductive layer in an amount of from about 0.05 to about 1 $g/m^2$ (preferably from about 0.10 to about 0.3 $g/m^2$) of the dry layer coverage. Mixtures of different types of metal oxide particles can be used if desired.

Imaging/Development

The thermally developable materials can be imaged in any suitable manner consistent with the type of material, using any suitable imaging source (typically some type of radiation or electronic signal for photothermographic materials and a source of thermal energy for thermographic materials). In some embodiments, the materials are sensitive to radiation in the range of from about at least 300 nm to about 1400 nm, and preferably from about 300 nm to about 850 nm. In other embodiments, the materials are sensitive to radiation at 700 nm or greater (such as from about 750 to about 950 nm).

Imaging can be achieved by exposing the photothermographic materials to a suitable source of radiation to which they are sensitive, including X-radiation, ultraviolet radiation, visible light, near infrared radiation and infrared radiation to provide a latent image. Suitable exposure means are well known and include sources of radiation, including: incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art, and others described in the art, such as in *Research Disclosure*, September, 1996, item 38957. Particularly useful infrared exposure means include laser diodes, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

Thermal development conditions will vary, depending on the construction used but will typically involve heating the imagewise exposed material at a suitably elevated temperature, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means.

When imaging thermographic materials, the image may be "written" simultaneously with development at a suitable temperature using a thermal stylus, a thermal print-head or a laser, or by heating while in contact with a heat-absorbing material. The thermographic materials may include a dye (such as an IR-absorbing dye) to facilitate direct development by exposure to laser radiation.

Packaging and Indicator Devices

The thermally developable imaging materials are packaged in various forms of enclosures after manufacturing. Such thermally developable imaging materials are usually packaged as multiple sheets in a "primary" packaging enclosure that is "light-tight" and prepared from black plastic, foil, a packaging box, or a combination of any of these. In some embodiments, the primary packaging enclosure is enclosed within, a "secondary" packaging enclosure that can include packaging boxes, cans, plastic wrap, or other materials that may be printed with manufacturer and product information. In other embodiments, the secondary packaging enclosure is not present and the primary packaging enclosure is used alone.

One or more indicator devices are associated or attached in a suitable manner to either or both of the primary and secondary packaging enclosures in such a manner that the devices can be "read" by an observer. For example, the indicator device can be removably attached to the outer surface of either the primary or second packaging enclosures. Conventional adhesive techniques can be used including those typically used in the label and decalcomania arts. The use of a pressure-sensitive adhesive layer with an associated release layer is particularly useful as such material can be used to provide strong adhesion to a variety of surfaces. Pressure-sensitive adhesives include polyesters, natural rubber, styrene butadiene rubber, acrylics, vinyl acetate copolymers, polyisobutylenes and other materials known in the art. The indicator device(s) may be provided with a release sheet over the pressure sensitive adhesive as is typical in the label and decal art that may be removed prior to attaching the indicator device to the packaging enclosure.

Alternatively, the indicator device(s) can be permanently attached to either or both of the primary and secondary packaging enclosures.

When attached in a suitable manner to the packaging enclosures, the indicator devices may be protected from tampering, damage, or moisture by applying or coating it with a transparent protective film or tape as long as the usefulness of the indicator device(s) is not diminished.

It is also possible to attach the indicator device inside the primary or secondary packaging enclosure as long as the indicator device and the data it provides are visible through the packaging enclosure(s).

The, indicator device(s) used in this invention comprise one or more means for providing a visually observable indication of a predetermined cumulative thermal exposure and one or more means for providing a visually observable indication of a predetermined temperature event.

By "predetermined cumulative thermal exposure", we mean the cumulative effect of exposure to temperature conditions over time.

By "predetermined temperature event", we mean a single temperature event such as a predetermined high temperature.

To provide the environmental temperature/history data, each indicator device generally has one or more compositions or formulations that will provide a change in image density or color in response to its exposure to various temperatures over time, or a composition that will undergo a phase change from solid to liquid at the predetermined temperature event. Thus, the indicator device can include a "first" image-changing formulation that is sensitive to the predetermined cumulative thermal exposure and a "second" image-changing formulation that is sensitive to the predetermined temperature event (or single temperature event). More particularly, the image-changing formulations can comprise chemical components, in reactive association, that are capable of an image density-producing or an image density-destroying chemical reaction, or appropriate solid to liquid phase changes. Specific details about preferred formulations of this type are provided below.

Examples of useful image-forming formulations include thermally sensitive compositions that can be coated in a thin layer onto or absorbed into a substrate (support), such as the acetylenic compositions described in U.S. Pat. No. 3,999,946 (Patel et al.) that can be conveniently fashioned into a removably attachable label that can be applied as an indicator device to the packaging enclosure.

More preferably, the image-changing formulations are non-photosensitive thermally sensitive compositions comprising a suitable organic silver salt and reducing agent as described above for the thermally developable materials in the "Non-Photosensitive Source of Reducible Silver Ions" and "Reducing Agents" sections. Such compositions are often characterized as "thermographic" imaging compositions or emulsions, and can further include toners (or "toning agents"), stabilizers, matting agents, lubricants, hardeners, antistatic agents, coating aids, brighteners, and other components commonly used in such compositions.

Preferred thermally sensitive compositions include an organic silver salt of a fatty acid, such as silver behenate, or mixtures thereof, as the non-photosensitive source of reducible silver ions, and preferred reducing agents include gallates and mono- and polyhydroxybenzene compounds.

All of the components (imaging or otherwise) are readily dispersed in a suitable binder (see Binder section above) and suitable coating solvents and coated onto suitable supports that can withstand the intended thermal exposure temperature ranges desired to be monitored for the thermally developable materials. The use of opaque or reflective supports may be advantageous in that even a very slight density or color image change (for example, as small as 0.05 units) in the thermally sensitive formulations may be more easily noticed. Polyesters and reflective papers are preferred supports for the indicator device(s).

The technology for making the image-changing compositions for the indicator devices is quite similar to that known for making the thermographic materials described above.

The image-changing formulations can be vertically integrated, that is applied on top of each other, or situated horizontally, in the indicator device.

To provide data relating to predetermined temperature event (that is, a single temperature event) of the packaged thermally processable materials, the indicator device can be designed with a composition that changes from a solid to a liquid at a specific temperature. For example, one such composition of this type includes polyethylene glycol whose melting point can be monitored.

To provide data relating to predetermined cumulative thermal exposure of the packaged thermally processable materials, the indicator device is designed to exhibit specific image density or color changes corresponding to specific time and temperature integrated exposures correlated to the specific sensitivity of the thermally developable material inside the package enclosure. The thermally sensitive formulations are designed to show predetermined progressive, predetermined changes in visual image density or color corresponding to the increased integrated time and temperature exposures. The optimum concentrations of organic silver salts and reducing agents will vary depending upon the particular time-temperature sensitivity desired for the indicator device. Total silver metal coverage of from about 0.1 to about 10 $g/m^2$ may be used but a silver coverage of at least 1 $g/m^2$ is desirable to form images with high densities for the indicator devices. In general, such components will be at higher levels than traditionally used for conventional thermographic imaging materials.

The indicator devices can have indicating indicia that are located adjacent the image changing formulations. These indicating indicia may comprise letters or graphics printed on the indicator device that become obscured by an image formed by the thermally sensitive formulation when the indicator device has been exposed to a sufficient cumulative thermal exposure. For example, the indicator device can have indicating indicia such as the lettering "GOOD", "FRESH" or "OK" in a transparent thermally sensitive formulation. In such an embodiment, as the indicator device is exposed to sufficiently high temperature over a sufficient period of time, the thermally sensitive formulation begins to darken, obscuring the indicating indicia. The change in image density may be correlated to known time and temperature integrated exposures, thus providing an indication of the cumulative time and temperature history of the packaged product to which the indicator device is attached.

Alternatively, the thermally sensitive image changing formulation may be coated onto a transparent support, and the indicator device directly disposed over and attached to a surface with printed indicating indicia, such as the surface of the packaging enclosure. The thermally sensitive formulation may alternatively itself be printed on a support to form a latent indicating indicia that become visible, or changes image color or density only upon sufficient thermal exposure to form a message such as "NO GOOD", or "HEAT DAMAGED".

In still other embodiments, the change in image color or density may be correlated to indicating indicia in the form of reference colors and/or density levels associated with predetermined levels of thermal exposure.

In yet another embodiment, the indicator device(s) comprising a thermally sensitive formulation may be used in association with indicating indicia in the form of a bar code such that a predetermined cumulative thermal exposure or a predetermined exposure temperature results in obscuring the bar code so as to render it unreadable by a bar code reader. The obscured bar code may then function to provide an indication that the thermally processable material in the package may have been damaged.

The indicator devices can also include a protective layer over the thermally sensitive formulation to provide protection from abrasion, humidity, and other outside influences. Protective overcoats can be composed of various polymeric materials that form a transparent film upon coating and drying. Protective overcoats can also be provided in the form of pressure sensitive laminated films. Alternatively, two elements comprising thermally sensitive formulations coated on supports, at least one of which is transparent, may be laminated together to form an indicator device with the thermally sensitive formulation sealed between the two supports, or a single element comprising a transparent support may be folded and laminated to seal the thermally sensitive formulation between the folded support.

In some embodiments of this invention, the indicator device is designed to provide a visually observable indication of various ranges of predetermined cumulative thermal exposure. Indicator devices of this type comprise at least two thermally-sensitive image-forming areas of differing thermal sensitivity along with indicating indicia in association with the thermally sensitive image-forming areas. The indicator device can then have thermally-sensitive areas that provide an indication of complete degradation of the packaged thermally processable materials while others indicate the progress in thermal effect on the packaged thermally processable materials. Further details of such arrangements are provided in U.S. Pat. No. 6,113,857 (noted above) that is incorporated herein by reference.

The indicator device used in this invention is relatively thin in size, having a total dry thickness of 2 mm or less and more likely from about 0.5 to about 2 mm.

In preferred embodiments of this invention, the packaged thermally developable material is a photothermographic material that comprises a support having thereon one or more thermally developable imaging layers comprising a binder, and having in association, a photosensitive silver halide (such as a silver bromide or silver iodobromide), a non-photosensitive organic source of reducible silver ions (such as an organic silver salt of a fatty acid including silver behenate), and a reducing agent for the reducible silver ions (such as a hindered phenol), the details of which are described above.

In more preferred embodiments, the indicator device and the packaged photothermographic material comprise the same non-photosensitive organic source of reducible silver ions and reducing agent for the reducible silver ions.

The following Examples are used to illustrate the present invention and the scope of the invention is not to be limited by them.

EXAMPLE 1

Indicator of Predetermined Cumulative Thermal Exposure

Thermally sensitive image-forming elements can be prepared by coating the thermographic composition shown in TABLE I below at a wet laydown of 70.0 g/m$^2$ on a poly(ethylene terephthalate) film support. Dispersion A can contain 18.0% by weight silver behenate and 4.0% by weight Butvar® B-76 poly(vinyl butyral) (Monsanto Co.) in an acetone/toluene solution. Binder Solution B can be 10% by weight poly(vinyl acetal) in methyl ethyl ketone. The polyvinyl acetal has a molecular weigh of 338,000 g/mole and can be obtained from Sekisui Company. Binder Solution C is a 10% by weight solution of Butvar® B-76 in methyl ethyl ketone. Toner D is a 10% by weight solution of succinimide in a 50/50 mixture of acetone/methyl ethyl ketone.

TABLE I

| Thermographic Composition Component | grams |
|---|---|
| Dispersion A | 33.45 |
| Binder Solution B | 48.46 |
| Binder Solution C | 4.56 |
| Dry n-propyl gallate reducing agent | 1.23 |
| Toner D | 12.31 |
| Total | 100.0 |

The coating can be dried at a temperature up to 77° C. for 2 minutes in an air chamber and then over-coated with a 2.8% by weight solution of poly(vinyl acetal) (mol. weight 100,000 g/mole, from Sekisui Co.) in methyl ethyl ketone at a wet laydown of 34.8 g/m$^2$. The coating can be dried at a temperature up to 77° C. for 2 minutes in an air chamber.

Film samples are then cut 35 mm by 10 inches long and incubated in humidity— and temperature-controlled ovens at 21.1° C. through 60° C. or held in a freezer at 4.4° C. for various intervals of time from 0 hours to 112 days. The samples are removed from the oven and the status A visual, red, green, and blue densities are measured in the transmission mode using an X-rite densitometer. The progression of density change versus time at each temperature of incubation is followed to determine the rate of density growth.

The composition of TABLE I is capable of indicating an accumulated time-temperature history by measurement of the density produced over time. The thermal composition can be tuned by appropriate choice of the reaction controlling materials. For instance, a slower reacting indicator device could be designed by replacing the silver behenate organic silver salt with a less reactive silver salt, such as silver benzotriazole or silver mercaptotetrazole. A faster reacting indicator device could be, designed by replacing the n-propyl gallate reducing agent with a more active reducing agent such as phenidone or a p-phenylenediamine type developer. A slower reacting indicator device could also be produced by using binders higher in $T_g$ (glassy transition temperature) or by removing or changing the toner compound.

A packaged photothermographic material labeled with such an indicator device could then be considered expired once the cumulative time-temperate indicator reached a prescribed threshold density.

EXAMPLE 2

Indicator of Predetermined Temperature Exposure

A piece of 26 point SBS paperboard blank is cut approximately three inches long by one-half inch wide. A solid colored patch is printed on one end of the blank with permanent black ink (HARDEE™ Black C manufactured by Beacon Ink, Somerville, Mass.) and indicia for recording date and time are printed at the other end of the blank. The ink is allowed to dry, and TEMPILAQ™ 156 is applied with a brush to the end of the blank bearing the colored patch. TEMPILAQ™ is supplied from Tempil Industries, South Plainfield, N.J. as an 18 volume percent solvent slurry. The TEMPILAQ™ 156 is allowed to dry, and the end of the blank bearing the Tempilaq 156 coating is encapsulated between two pieces of PERMACEL™ P-925 pressure sensitive transparent polyester tape. The tape is sufficiently long to extend approximately one-half inch beyond the Tempilaq 156 patch coating on the blank, and approximately one-eighth inch above each side edge of the paperboard blank so that the facing adhesive coated edges of the tape may contact one another and completely encapsulate and seal the lower half of the blank. The tape-to-tape seal preferably can be accomplished by making the paperboard blank narrower at the functional end, i.e. the end bearing the colored patch. The tape pieces are pressed firmly onto the blank, and particular care is taken to press firmly together the facing extensions of the two tape pieces.

The resulting indicator device can be tested in an oven against a calibrated thermocouple. Prior to insertion into the oven, the tip of the device appears white. The indicator device is found to reveal the underlying patch at 71° C., slightly above the designed melting point of the Tempilaq 156 (68.9° C.). The temperature of device activation can be tuned by applying appropriately dispersed thermochromic materials with different melting points. A photothermographic product labeled with such an indicator could then be considered expired once the device indicated a prescribed threshold temperature has been reached.

EXAMPLE 3

Indicator of Predetermined Cumulative Thermal Exposure

A multilayer indicator device can be prepared by combining primary and secondary indicator compositions, binders, and fillers. The wet ink formula, by weight, is 51 parts of a 10% solution of Klucel (Hydroxy propyl cellulose, Type EF, Aqualon Co.), 17 parts of a co-crystallized mixture of 2,4-hexadiyn-1,6-bis (ethyl urea), and 2,4-hexadiyn-1,6-bis (n-propyl urea) at a mole rate of 2:1, 6 parts of 4% FD&C blue No. 1 suspension in 7 parts of 50% titanium dioxide (R900, DuPont Corp.), 10 parts china clay (English Colloidal Kaolin, Whittaker, Clark & Daniels), and 15 parts cyclohexanone. Quarter inch diameter circles are screen printed on a 2 mil clear polyester film using the above ink and a T40 monofilament polyester fabric. Polyethylene glycol (PEG) (E3350 Dow Chemical Co.,) having a melting point of 54° C. is heated to 60° C. and a thin coating of the molten material is applied to the printed layer. The PEG rapidly solidifies forming a continuous layer. Polyart 2 backing layer is applied to the back of the printed dots. The adhesive of layer seals around the printed image and effectively encapsulates the indicator device and prevents the migration of the PEG when melted.

These multilayer indicator devices can be incubated at 65° C. and periodically removed from a temperature-controlled chamber for inspection. The color of the indicator can be measured with a MacBeth PCM2 reflectance meter set on Filter E. Samples without the PEG layer (the heat fusible layer) can also be placed in the same temperature controlled chamber.

This indicator device with PEG can develop color more quickly than the indicator device without PEG, above the melting point of the PEG. The sample without PEG can show the cumulative effect of time and temperature on the primary ink layer alone. By appropriately manipulating the melting point of the material in the intermediate layer, one can tune the activating temperature of the device. By changing the rate constant of the reaction in the ink layer, one can also tune the Arrhenius sensitivity of the cumulative time-temperature integrating device. A packaged photothermographic product labeled with such indicator devices could then be considered expired once the cumulative time-temperature indicator reached a prescribed threshold density.

The invention has been described in detail with particular reference to certain preferred embodiments thereof, but it will be understood that variations and modifications can be effected within the spirit and scope of the invention.

The invention claimed is:

1. A packaged thermally developable product that is a thermographic or photothermographic material, said packaged thermally developable product comprising:

a) a primary packaging enclosure containing one or more of said thermally developable materials, b) at least one non-photosensitive indicator device adapted to provide both a visually observable indication of a predetermined cumulative thermal exposure and a predetermined temperature event, said indicator device comprising at least one image-changing formulation that comprises a non-photosensitive source of reducible silver ions and a reducing agent for said reducible silver ions, c) optionally, a secondary packaging enclosure containing said primary packaging enclosure, wherein said indicator device is associated with said primary packaging enclosure or if said secondary packaging enclosure is present, said indicator device is associated with either said primary or secondary packaging enclosure, or both.

2. The product of claim 1 wherein said indicator device is associated with the outer surface of said primary packaging enclosure and said secondary packaging enclosure is not present.

3. The product of claim 1 wherein said indicator device comprises a substrate having thereon a first image-changing formulation that is sensitive to said predetermined cumulative thermal exposure and a second image-changing formulation that is sensitive to said predetermined temperature event.

4. The product of claim 3 wherein said first image-changing formulation comprises chemical components capable of an image density-producing or image density-destroying chemical reaction, which chemical components are in reactive association, and said second image-changing formulation comprises a visual image density patch covered in whole or in part with a composition that includes a component that undergoes a phase change from solid to liquid at said predetermined temperature event.

5. The product of claim 3 wherein said indicator device further comprises indicating indicia in association with said image-changing formulations for indicating when said product has been exposed to a predetermined cumulative thermal exposure and a predetermined temperature event.

6. The product of claim 5 wherein said indicating indicia are located adjacent said image-changing formulations.

7. The product of claim 5 wherein said image-changing formulations are disposed over said indicating indicia.

8. The product of claim 5 wherein said indicating indicia become visible as said image-changing formulation is exposed to said predetermined cumulative thermal exposure or said predetermined temperature event.

9. The product of claim 5 wherein said indicating indicia become obscured as the first and second image-changing formulations are exposed to said predetermined cumulative thermal exposure and said predetermined temperature event.

10. The product of claim 2 wherein said indicator device is removably attached to the outer surface of said primary packaging enclosure with a pressure sensitive adhesive.

11. The product of claim 1 wherein said secondary packaging enclosure is present and said indicator device is removably attached to the outer surface of said secondary packaging enclosure with a pressure sensitive adhesive.

12. The product of claim 1 wherein said indicator device is permanently attached to the outer surface of said primary packaging enclosure or to said secondary packaging enclosure or to both when said secondary packaging enclosure is present.

13. The product of claim 1 wherein said primary or secondary packaging enclosure comprises a packaging box.

14. The product of claim 1 wherein said indicator device is visible through said primary or secondary packaging enclosure, if present, or through both when said secondary packaging enclosure is present.

15. The product of claim 1 wherein said indicator device is less than 2 mm in total thickness.

16. The product according to claim 3 wherein said first and second image-changing formulations are vertically integrated.

17. The product according to claim 3 wherein said first and second image-changing formulations are situated horizontally.

18. The product of claim 3 wherein said first or second, or both, image-changing formulations comprise a non-photosensitive organic source of reducible silver ions and a reducing agent for said reducible silver ions.

19. The product of claim 1 wherein said thermally developable material is a photothermographic material that comprises a support having thereon one or more thermally developable imaging layers comprising a binder, and having in association, a photosensitive silver halide, a non-photosensitive organic source of reducible silver ions and a reducing agent for said reducible silver ions.

20. The product of claim 19 wherein said indicator device and said photothermographic material comprise the same non-photosensitive organic source of reducible silver ions and reducing agent for said reducible silver ions.

21. The product of claim 1 wherein said thermally developable material is a non-photosensitive thermographic material.

* * * * *